United States Patent [19]

Teshima et al.

[11] 4,334,725

[45] Jun. 15, 1982

[54] METHOD FOR MAKING A FLUORESCENT LAMP

[75] Inventors: Toru Teshima, Hadano; Kazuo Ariga, Tokyo; Norimasa Oinuma, Machida; Mitunari Yoshida, Yokohama, all of Japan

[73] Assignee: Stanley Electric Co., Ltd., Tokyo, Japan

[21] Appl. No.: 183,294

[22] Filed: Sep. 2, 1980

Related U.S. Application Data

[62] Division of Ser. No. 870,853, Jan. 19, 1978, Pat. No. 4,272,702.

[30] Foreign Application Priority Data

Jan. 28, 1977 [JP] Japan ..... 52-8949
Jan. 28, 1977 [JP] Japan ..... 52-10248

[51] Int. Cl.[3] ..... H01J 9/18
[52] U.S. Cl. ..... 316/19; 29/25.13
[58] Field of Search ..... 313/493, 174, 220, 318; 316/17, 19; 29/25.13

[56] References Cited

U.S. PATENT DOCUMENTS 3,904,916 9/1975 Emidy et al. ..... 313/493
4,195,249 3/1980 Ariga et al. ..... 313/493

*Primary Examiner*—Mark Rosenbaum
*Attorney, Agent, or Firm*—Charles E. Pfund

[57] ABSTRACT

A method for making a fluorescent lamp from a pair of molded, flat glass shells. Substantially semi-circular recesses are formed on each shell on bonding surfaces thereof opposite semi-circular recess formed on the other glass shell, so that when the shells are bonded together, a circular orifice is formed on the lamp. An exhaust tube is provided, and a stem is affixed to an end of the exhaust tube, and an electrode filament and a getter plate are secured to the stem. The shells are bonded together with a glass adhesive and simultaneously therewith, the exhaust tube is sealed into the orifice so that the getter plate and the electrode filament thereof are disposed within the space between the bonded shells. The gases within the space between the shells are exhausted and mercury and an inert gas are injected into this space. The exhaust tubes then are sealed.

2 Claims, 2 Drawing Figures

METHOD FOR MAKING A FLUORESCENT LAMP

This is a division, of application Ser. No. 870,853, filed Jan. 19, 1978, now U.S. Pat. No. 4,272,702.

BACKGROUND OF THE INVENTION

The present invention, a division of U.S. Pat. No. 4,272,702, relates to a method for making a fluorescent lamp which is constituted by joining a pair of shells of glass that at least one of the shells is molded and more particularly to a method for making a fluorescent lamp in which an exhaust tube and lead-in wires of stem mounted thereon are hermetically fixed in a recess previously formed on the shells by adhering or by welding.

DESCRIPTION OF THE PRIOR ART

The demands of state of the art indicators requires that each one have a self-contained light source. The bases for this requirement are that the indicator be clearly visible, that various colors be utilized to facilitate the differentiation of one indicator from other existing indicators, and that the indicator be aesthetically pleasing.

However, since the conventional indicating device which self-contains a light source is circular or cylindrical in its configuration, in order to uniformly illuminate an indicating surface made by synthetic resin or the like, a certain distance is necessary between the light source and the indicating surface and a diffusion plate must be inserted into a middle portion between the light source and the indicating surface. Because of this spacing requirement, the indicating device will necessarily be larger in size. In addition, since the diffusion plate interrupts the light, the brightness of the illumination of the indicating surface is reduced. Although no such problem will arise in a large-sized indicating device, the problem is of considerable difficulty in a small-sized indicator.

In the conventional fluorescent lamp there is known a stucture which comprises an exhaust tube disposed in a cutway portion on the periphery of one of receptacles, electrode filaments mounted on and arranged to lead-in wires to put a partition provided inside of the receptacle between the filaments, the other receptacle rested on the receptacle, and glass adhesive having low melting point jammed between the peripheral and center circular jointing surfaces of the receptacles so as to seal and fix the receptacles by heat. In this structure, the manufacturing step is relatively reduced since the exhaust tube is previously provided in the cutway portion of one of the receptacles and the electrode filaments and the lead-in wires are jointed when the receptacles are jointed. However, the electrode filaments are not avoidable from wrong affections occurring from heating temperature when jointing the receptacles and further are difficult to arrange it at a normal position and are easy to cause their deformations. Accordingly, in order to solve these defects the structure becomes complicated in the manufacturing process becomes more expensive.

In a fluorescent lamp of such a structure, a large amount of glass adhesive having low melting point (solder glass) is necessary as a soldering agent in order to solder the lead-in wires put between the receptacles.

In order to mass-produce such a discharge lamp, there has been proposed a method which solders a thin film made by screen-printing the grass adhesive having low melting point (solder glass), as a method which is better in yield rate and work efficiency. However, when the lead-in wires are inserted between the soldering surfaces of the receptacles of glass the use of the screen-print is difficult because of the necessity of increasing the thickness of the glass adhesive having low melting point (solder glass) used as a soldering agent and care must be taken to make the joint air-tight near the lead-in wires.

In the other conventional fluorescent lamp, the structure comprises a pair of ring receptacles of glass and formed in generally circular shape in section, a portion for inserting an electrode formed in short cyrindrical shape on a portion of the receptacles and adapted to enclose therein lead-in wires supporting an electrode filament, glass adhesive having low melting point for adhering and fixing inner and outer peripheries of the receptacles, an exhaust tube formed in the same manner as the portion for inserting electrode and adapted to be enclosed after exhausting, and a partition provided to intercept the discharge passage between the electrode filaments.

In this structure, since the portion for inserting electrode and the portion for mounting the exhaust tube on the one of the receptacles are previously formed on one receptacle, and since the other receptacle is joined with the one receptacle after enclosing the electrode filaments, the number of production steps is increased; therefore the manufacturing process becomes complicated and the cost becomes higher. In addition, damage to the portion for enclosing the electrode and the electrode filaments occurring from the heating temperature when jointing the receptacles.

In the above conventional lamp also since the exhaust tube and the electrode portion are fixed independently on the periphery of the receptacles, it is not suitable for mass-production and further it has a defect that the position of the disposed electrode filaments is uncertain.

In the fluorescent lamp as mentioned above, it has been known that a blackening phenomenon occurs near the electrode during use. It is stated as the cause that the electrode is gradually damaged or broken down by ion bombardment when starting the fluorescent lamp whereby the lamp wall becomes black by sputtering of the electrode itself and the oxide of the electrode material, and a power loss occurs from the voltage drop presented at the electrode.

In order to prevent the blackening phenomenon, it is effective to prevent the sputtering of the oxide of the electrode material as possible and to catch and adsorb the sputtering material before it reaches the lamp wall and to minimize the voltage drop at the electrode.

An electrode part generally used in such a lamp is composed of a preheated electrode to which is applied an oxide of an alkali earth metal which serves as a layer of electron emission material directly on the electrode filament supported on a stem through the intermediary of inner lead-in wires. In this case an auxiliary electrode is supported on the lead-in wires and at the peripheral side of the electrode filament so as to make the start of discharge easy and is disposed to not disturb the discharge passage between the electrodes. In the electrode part of such a structure, it has a defect that a spot is easy to cause locally near the electrode thereby to have a bad influence upon the life time of the lamp.

As an improvement of the above conventional electrode, there has been proposed a electrode structure in which the electrode is adapted to keep warm by means of a cylindrical screen. This is so intended that the cylindrical screen reduces a chance of occurrence of local electrode spot and catches the sputter emitting from the electron emission material applied to the electrode filament thereby to prevent advance of the blackening in the discharge lamp. However, in this structure, because the heat capacity is large, greater time is required to start discharge. Further, in a case of a small-sized discharge lamp, it has defects that because the voltage drop becomes larger the dark portions at both sides of the discharge lamp attract attention and that the lamp becomes black in reflecting the color tone of the screen.

OBJECT OF THE INVENTION

It is an object of the invention to provide a method for making a fluorescent lamp which is suitable for various applications necessitating a small surface source of light.

It is another object of the invention to provide a method for making a flat fluorescent lamp in which an exhaust tube and lead-in wire of a stem are hermetically fixed by adhering or by soldering in a recess previously provided on shells.

It is a further object of the invention to provide a method for making a fluorescent lamp having an electrode structure which is adapted to prevent reduction of luminous flux resulting from blackening near the electrode.

The above and other objects and features of the invention will be understood more fully hereinafter from a consideration of the following description taken in connection with the accompanying drawings.

DETAILED DESCRIPTION OF THE PREFERRED EMBODIMENTS

Figure 1:
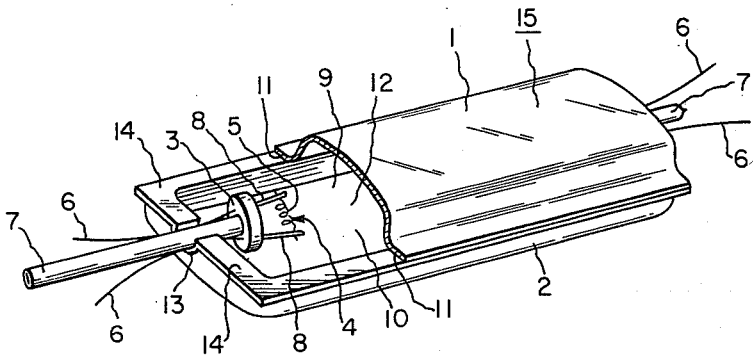
FIG. 1 is a partially cutaway perspective view showing an embodiment of a small-sized fluorescent lamp according to the invention.

Referring to FIG. 1, there is shown a fluorescent lamp having flat side surfaces. Glass shells 1 and 2 forming the side surfaces are made by molding, as shown in FIG. 1. Upon molding of the shells 1 and 2 on a longitudinal end of the shells a generally circular recess 13 is formed to make a circle when overlapping the jointing surfaces 14 of the shells to meet each other.

Fluorescent material 9 is applied and stained on inner surfaces of the shells 1 and 2. Reference numeral 8 is a supporting wire for supporting an electrode filament 4. The supporting wire 8 is provided on a stem 3.

The electrode filament 4 is made from, for example, tungsten. The surface of the electrode filament 4 is covered by alkali earth metals used as an electron emission material. In the recess 13 provided on the jointing surface of the shells 1 and 2 are fitted outer lead-in wires 6 and 6 and an exhaust tube 7 as shown in FIG. 1 and they are adhered or soldered integrally with each other by means of glass adhesive 11 having low melting point applied between the jointing surfaces of the shells 1 and 2. With the adhering or soldering, the recess 13 of the shells, the outer lead-in wires and the exhaust tube are tightly fixed and thus the inside of the shells is sealed in an air-tight condition.

A body 15 formed by joining the shells 1 and 2 removes impure gas to outside through the exhaust tube 7 and thereafter encloses the least amount of mercury vapor 10 and inert gas 12 which are necessary for discharge. After completion of these works the exhaust tube is tipped off. The outer lead-in wires 6 and 6 extending to the outside are electrically connected with base pins (not shown) by soldering or the like. In the above description though each part relates to those placed in the left hand portion of the lamp in in FIG. 1, it should be understood that the same parts are arranged opposite to the described parts in the right hand portion of the lamp in in FIG. 1.

A special feature in the structure of the fluorescent lamp according to the invention exists in the mounting portion of the stem which is mounted on the glass shells 1 and 2. In the conventional lamp, the stem installing the electrode filament is disposed by fusion on one of the divided receptacles. Otherwise only the exhaust tube is disposed with fusion and the other portion overlaps the divided receptacles when forming the body of receptacles or is enclosed after inserting the lead-in wires between the receptacles. Accordingly, the lamp is complicated in its manufacturing processes and is high in cost. Further, since the lamp necessitates heat upon adhesion of the receptacles, damage to the electrode due to the high temperatures cannot be avoided.

In order to solve the above defects, the present invention is away from the conventional concept relating to the stem seal and is so constituted that the shells are hermetically fixed by the exhaust tube and lead-in wires supported on the stem. That is, in the conventional concept of the stem seal, it is a practical wisdom that the air-tight enclosing is performed at the flare portion or at the button portion in a case of the flare stem or the button stem. In the lamp of the present invention, the sealing is performed by the exhaust tube and lead-in wires supported by the stem.

With such a construction of the invention the recess 13 on the body 15 becomes smaller and the surface source of light is obtained in a very thin and flat condition by only boring a frame in a thin plate. Special care is not necesary in spacing the light source and the indicating surface since the indicating pattern, such as letters, figures or the like is formed or mounted directly or indirectly on the thin and flat indicating surface. It further is capable of obtaining the desired indication easily without disposing an additional member, for example, a diffusion plate. The flat configuration of the lamp of the present invention is easily produced in the molding thereof, because of the small size of recess 13. Accordingly, it is desirable in the production of the lamp to select a method for sealing the stem which inserts tightly the lead wires 6 and 6 and the exhaust tube 7 into small recess 13 previously formed on the portion of the glass shells and which adheres or solders them. Although the screen printing process cannot be used to seal the recess 13, the air-tight adhesion near the latter may be performed by applying a desired glass adhesive having low melting point (solder glass).

In the conventional structure, the receptacle body is not formed directly by joining a pair of molded glass receptacles together as in the present invention. Accordingly, when the stem is enclosed in the glass receptacles the opening is required to be larger than the size of the electrode affixed to the stem. The large opening is not desirable for the thin and small-sized discharge lamp.

Consequently, if the receptacle body is formed by joining together the molded glass shells as in the present invention since the stem can be easy enclosed in the shells by fixing the exhaust tube together with the lead-in wires in the small recess in a tight fitting condition the structure of the thin and small-sized discharge lamp may be greatly simplified.

With the structure of the invention as mentioned above, as compared with the conventional surface source of light adapted to obtain a uniform illumination by adjustment of the distance between the light source and the indicating surface or by use of the diffusion plate, because the light source itself is a thin, flat and uniform surface source of light the whole lamp may be produced in a small-sized, thin and flat configuration if the surface source of light is formed integrally with the indicating surface. Accordingly, the indication can be obtained in the very striking and clear condition.

In the invention the luminous color may be changed by pre-selecting the fluorescent material and therefore a colorful indication can be attained by the combination of the indicating pattern and the luminous color.

In the present invention, the indication is made on both sides of the body of the lamp. However, a very light indication can be obtained by only one side of the lamp where reflective material such as aluminium, titanium oxide or the like is applied or vacuum-evaporated on the other side of the lamp.

In the present invention, pre-staining of the fluorescent material is not necessary since the staining can be performed at the same time the shells are enclosed. Further, since ornamental patterns are easily formed on the surfaces of the shells, the lamp can be used as an indoor instrument, that is, an interior decoration in cooperation with the color effect.

In the fluorescent lamp according to the invention as mentioned above, a superior lamp can be provided by having an arrangement which is adapted to remove a blackening phenomenon causing near the electrode.

Figure 2:
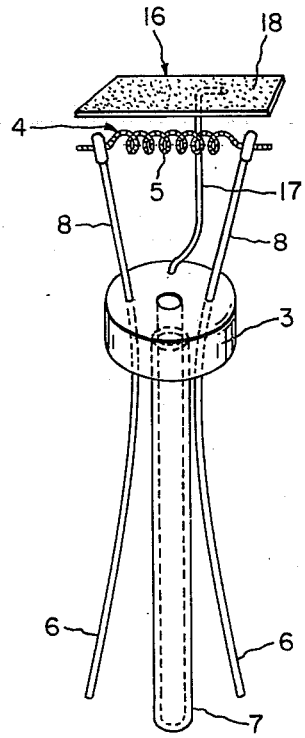
FIG. 2 is a perspective view showing an improved structure of electrode part used in the fluorescent lamp according to the invention.

Referring to FIG. 2, there is shown the structure of the stem 3. Lead wires 8 and 8 made from a conductive metal, such as nickel support an electrode filament 4 of tungsten. An anode getter plate 16 is mounted on a supporting bar 17 independently of any electric circuit including that of the electrode filament 4 and is disposed directly opposite electrode filament 4 so as to interrupt a direction of electron emission from the electrode filament 4. On a surface of the getter plate 16 is applied a getter materials 18 consisting of, for example, alloy of aluminium, zirconium or the like. In this case, the getter material made by the SAEZ Company is effective.

The electrode filament 4 is usually covered by a layer 5 of alkali earth metal used as an electron emissive material. The electrode filament 4 is supported on a stem 3 by lead wires 8 and 8. The stem 3 supports outer lead wires 6 and 6 and an exhaust tube 7 passing therethrough.

As an example, the getter plate of the present invention may be manufactured by applying fine powders such as zirconium, aluminium or the like as a getter material 18 on a surface of a base plate of iron, nickel or the like.

Some structural features of the invention are (1) that getter plate 16 that is supported by the supporting bar 17 independently of any electric circuit including that of the electrode filament 4, (2) that the anode getter plate 16 that is arranged at a position so as to prevent passage of electron emissive material from one electrode to the other electrode part, and (3) that a getter function is performed by the getter plate itself.

In the structure of the invention, it is necessary to determine a width dimension of the getter plate 16 so as to have an area corresponding to about three to five times the projected area of the electrode filament 4. By having such a width dimension, even if the getter plate 16 is arranged in a position such that it covers electrode filament 4 as shown in FIG. 2, since the area of the getter plate 16 is at most three to five times that of the projected area of the electrode filament 4 the electron discharge is permitted to go around the periphery of the getter plate 16 and the flow is not adversely affected by the getter plate 16.

In relation to an electrode filament, the spot has a somewhat large extent and the temperature of the spot is lower when a getter plate 16 is provided. If the getter plate were not provided the spot would be localized and the temperature thereof would be much higher.

Furthermore, a getter plate 16 serves to reduce the voltage drop at the electrode filament, which is one problem on the design of the discharge lamp having a lower pressure gas such as fluorescent lamp and thereby the dark portion near the electrode becomes smaller. Accordingly, since the uniform illumination is obtained at each portion of the longitudinal direction of the lamp and the shade and color of the anode getter plate itself are not reflected to the outside, the good discharge can be obtained. It has been known that the above phenomenon of the electrode filament voltage drop results from negative space charge appearing around the electrode filament and may be reduced as the electrode filament dimension is increased to correspond to the energy which must give to overcome the resistant force of the space charge. In the present invention the cause of blackening is removed by forming the getter material 18 integrally on the getter plate 16 and thereby the blackening phenomenon can be prevented.

According to the present invention, the temperature of the getter plate 16 rises immediately after start of the discharge and therefore the impure gas produced by the electrode and the other portions of the lamp can be fully adsorbed on the surface of the getter plate. Consequently, since the blackening of the tube wall is remarkably reduced in the discharge lamp the high flux of light can be maintained till to the end of the life time.

With the invention, the electric power required for the lamp can be reduced by about 5% due to the utilization of the getter plate 16. Further, since the size of the electrode filament spot is increased somewhat and the temperature of the lamp is considerably lower than that found in a lamp which does not have a getter plate 16. the life time of the lamp can be extended considerably.

According to the invention, the dark area normally produced by a voltage drop near the electrode is not present and a uniform illuminating light can be obtained. It also has an of the getter plate 16 is such that it operates effectively as a getter without producing a shadow visible outside the lamp.

As mentioned above, with the invention, it can provide a fluorescent lamp which is small-sized and which has a long life time. The lamp according to the invention is suitable for very wide range of applications, such as an indicating light for indicating room name, room number, direction guide or the like in house, hotel or the like, an indicating light for informing counter or the like, an indicating light for automatic vending machine, instrument or the like, an all-night light, a comfortable illumination lamp, a light source for liquid crystal indicator, a pannel for automobile, a room lamp, a reading lamp, other illumination which necessitates a small-sized surface source of light or the like.

While the invention has shown and described certain present preferred embodiments it is to be distinctly understood that the invention is not limited thereto but may be otherwise variously embodied within the scope of the following claims.

What is claimed is:

1. A method of making a fluorescent lamp comprising the steps of:

molding a pair of similarly shaped glass shells having a flat configuration, each of said shells being formed with bonding surfaces peripherally thereof and with a pair of semi-circular recesses in said bonding surfaces, with each of said recesses being spaced from the other of said recesses;

affixing a stem to one end of each one of a pair of exhaust tubes;

supporting an electrode filament and a getter plate from each stem, the getter plate being electrically insulated from its associated exhaust tube and electrode filament;

connecting a pair of lead wires to each electrode filament, each pair of lead wires extending longitudinally of an associated one of the exhaust tubes;

coating interior surfaces of said shells with a fluorescent substance;

applying a low-melting point glass adhesive to said bonding surfaces of said shells;

bonding said shells together along said bonding surfaces by fusion welding to form an interior space, said shells being bonded together so that each recess formed on bonding surfaces of one of said shells is disposed opposite an associated recess formed on the bonding surfaces of the other of said shells to form a pair of circular openings;

sealing into each of said openings one of said exhaust tubes having a stem affixed thereto and an electrode filament and a getter plate supported from the affixed stem, and a pair of said lead wires connected to the supported electrode filament, the associated stem, getter plate and electrode filament being sealed with said space, said sealing step being simultaneous with said bonding step;

exhausting through said exhaust tube impure gases from said space;

injecting through said exhaust tube into said space a predetermined amount of mercury and an inert gas; and closing said exhaust tube, said lead wires being adapted to be electrically connected to connector pins externally of said lamp.

2. A method according to claim 1 wherein said bonding step and said sealing step create an air-tight seal around said space.

* * * * *